US007112132B2

(12) United States Patent
Yamagishi

(10) Patent No.: US 7,112,132 B2
(45) Date of Patent: Sep. 26, 2006

(54) PRIZE MANAGEMENT SYSTEM OF GAME MACHINE

(75) Inventor: Junichi Yamagishi, c/o Unirec Co., Ltd., 6-3, 2-chome, Kaminarimon, Taito-ku, Tokyo (JP) 111-0034

(73) Assignees: Junichi Yamagishi, Tokyo (JP); Unirec Co., Ltd., Tokyo (JP)

( * ) Notice: Subject to any disclaimer, the term of this patent is extended or adjusted under 35 U.S.C. 154(b) by 396 days.

(21) Appl. No.: 10/143,218

(22) Filed: May 9, 2002

(65) Prior Publication Data

US 2003/0211876 A1 Nov. 13, 2003

(51) Int. Cl.
*A63F 9/24* (2006.01)

(52) U.S. Cl. ..... 463/1

(58) Field of Classification Search ..... 463/7, 463/16, 37, 1; 273/142 R, 448; 700/236, 700/244

See application file for complete search history.

(56) References Cited

U.S. PATENT DOCUMENTS 5,271,628 A * 12/1993 Okada ..... 273/448
5,982,284 A * 11/1999 Baldwin et al. ..... 340/572.8
6,609,969 B1 * 8/2003 Luciano et al. ..... 463/16

FOREIGN PATENT DOCUMENTS

| | | |
|---|---|---|
| JP | 07-148344 | 6/1995 |
| JP | 07-246282 | 9/1995 |
| JP | 2001-276411 | 10/2001 |

OTHER PUBLICATIONS

U.S. Appl. No. 60/153,765 filed Sep. 13, 1999.*

* cited by examiner

*Primary Examiner*—Xuan M. Thai
*Assistant Examiner*—Robert Mosser
(74) *Attorney, Agent, or Firm*—Jordan and Hamburg LLP

(57) ABSTRACT

There is provided a prize management system of a game machine in which a plurality of kinds of prizes (3, 5, . . . ) are accommodated in a case (1), a player operates from the outside of the case to select and catch his/her favorite prize, and the selected prize is discharged to a taking-out port, comprising a non-contact detection section (41) provided with each one of the prizes for specifying a kind of each prize, chute sections (25) and (27) for passing the prize in a path leading to the taking-out port of the prizes, reading sections (29, 31) for reading with non-contact the detection section of the prizes passing through the chute section. The prizes are managed on the basis of a result read by the reading section.

3 Claims, 3 Drawing Sheets

PRIZE MANAGEMENT SYSTEM OF GAME MACHINE

BACKGROUND OF THE INVENTION

1. Field of the Invention

The present invention relates to a prize management system of a game machine.

2. Description of the Related Art

FIG. 3 shows a schematic game machine according to a related art. This game machine is configured so that a plurality of kinds of stuffed animals 3, 5, . . . are accommodated in a case 1, and a player his/herself can operate to acquire a prize. In other words, the case 1 is provided with a transparent prize accommodating chamber 7 which front face is made of glass, and a plurality of kinds of stuffed animals 3, 5, . . . are accommodated as prizes in the prize accommodating chamber 7. Further, the case 1 is provided with drop ports 9 and 11, and at the lower portion thereof, taking-out ports 13 and 15 for taking out prizes are provided. Then, movable holders 17 and 19 are provided in the prize accommodating chamber 7. These movable holders 17 and 19 are operated by a player through, for example, buttons 21 and 23 and the like provided on the front face of the case 1.

When the player operates the button 21 or 23, moves the holder 17 or 19 to catch his/her favorite stuffed animal 3, 5, . . . , the holder 17 or 19 automatically moves to the drop port 9 or 11, and releases to drop the caught stuffed animal on the drop port 9 or 11. Accordingly, the player can take it out from the taking-out port 13 or 15.

Therefore, when the player succeeds in catching the stuffed animal 3, 5, . . . by the holder 17 or 19, he/she can acquire the stuffed animal 3, 5, . . . from the taking-out port 13 or 15.

In order to confirm what kind of stuffed animals 3, 5, . . . are preferred and selected by players and how many stuffed animals in the prize accommodating chamber 7 have decreased, an administrator of the game machine needs to count the number thereof one by one. As a result, there has been a problem that the management is remarkably complicated.

SUMMARY OF THE INVENTION

The present invention provides a prize management system of a game machine, capable of remarkably facilitating a prize management of the game machine.

A first aspect of the present invention provides a prize management system of a game machine, having a case for accommodating a plurality of kinds of prizes, a taking-out port provided with the case, to discharge a prize a player operates from the outside of the case to select his/her favorite, a detection section provided with each one of the prizes for specifying a kind of each prize, which is detectable in a non-contacting manner, a chute section for passing the prize in a path leading to the taking-out port of the prize, a reading section for reading with non-contact the detection section of the prize passing through the chute section, and management means for managing prizes in the case on the basis of a result read by the reading section.

A second aspect of the prize management system according to the first aspect, wherein the detection section is an RF tag, and the reading section is a reader circuit for reading an RF antenna provided in the chute section and a signal of the RF antenna. According to the first aspect, when the player operates from the outside of the case, selects his/her favorite prize, and takes out the selected prize from the taking-out port, the prize passes through the chute section. The reading section can read with non-contact the detection section of the prize passing through the chute section. The result read by the reading section is input into the management means so that the prizes in the case can be managed. Therefore, an administrator of the game machine does not need to count the number of prizes in the case his/herself, and can know what prizes are preferred by players in the game machine in which a plurality of kinds of prizes are accommodated, and conduct a restock of prizes with remarkable ease.

According to the second aspect, in addition to the effect of the first aspect, the detection section is an RF tag, and the reading section is a reader circuit for reading an RF antenna provided in the chute section and a signal of the RF antenna. Therefore, the prize management can be reliably conducted according to the signal read by the reader circuit.

DETAILED DESCRIPTION OF THE PREFERRED EMBODIMENT

Figure 1:
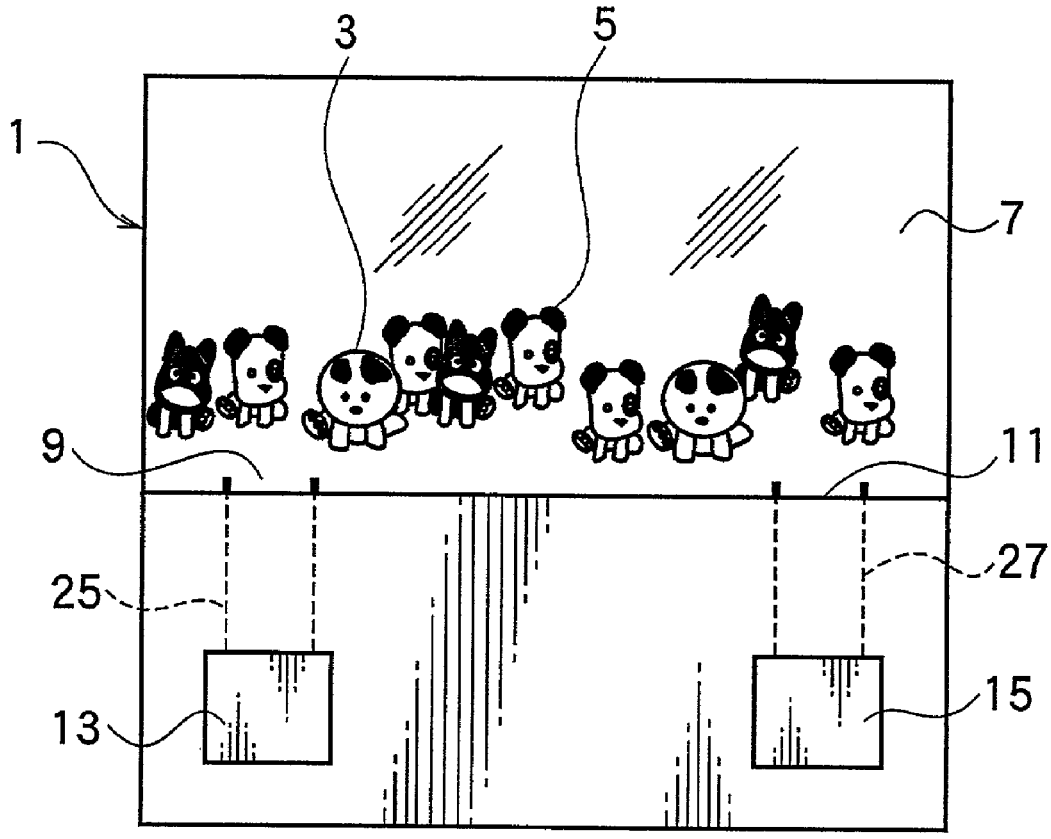
FIG. 1 is a schematic configuration diagram of a game machine according to an embodiment of the present invention.
Figure 2:
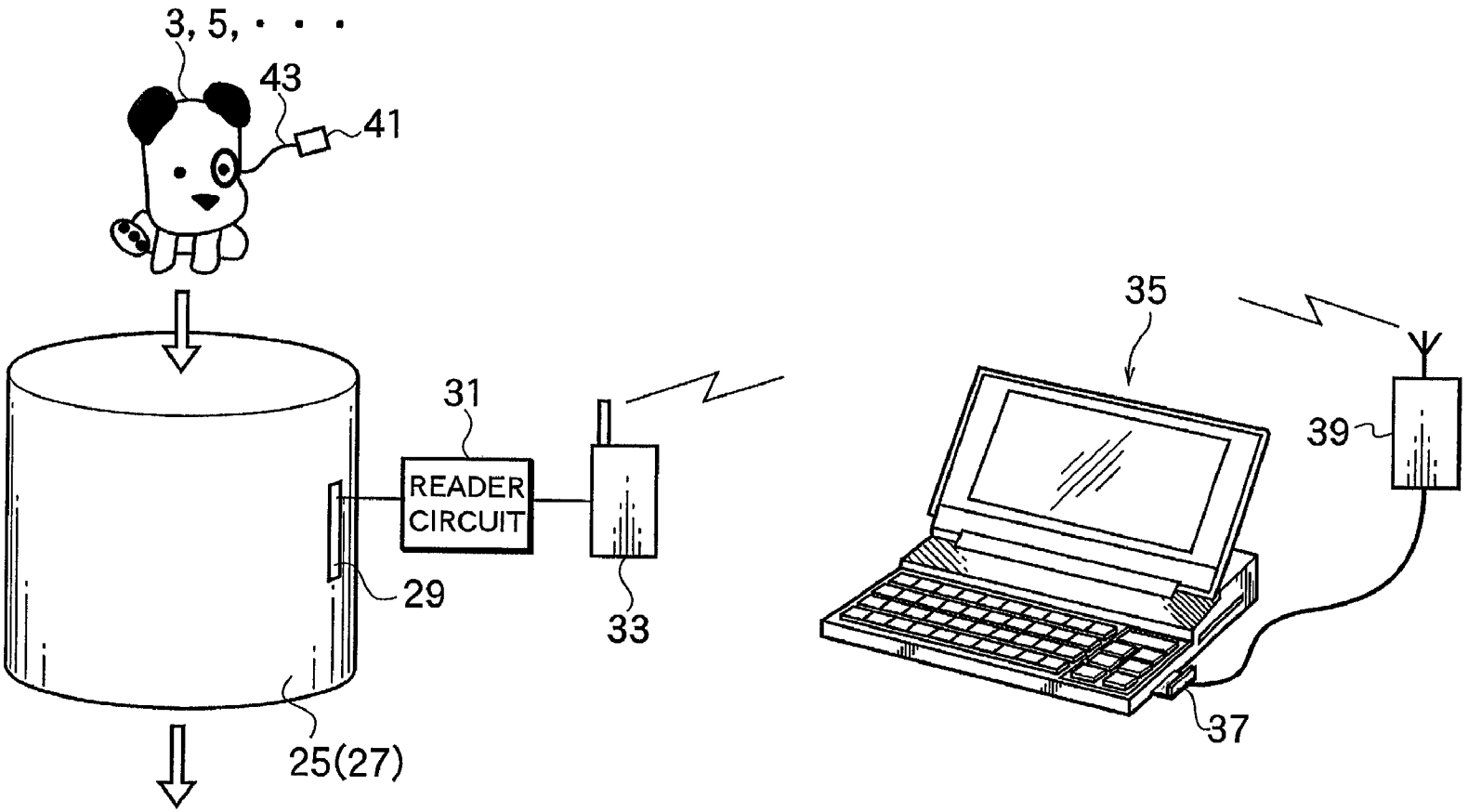
FIG. 2 is a schematic configuration diagram of essential parts of the game machine according to the embodiment of the present invention.
Figure 3:
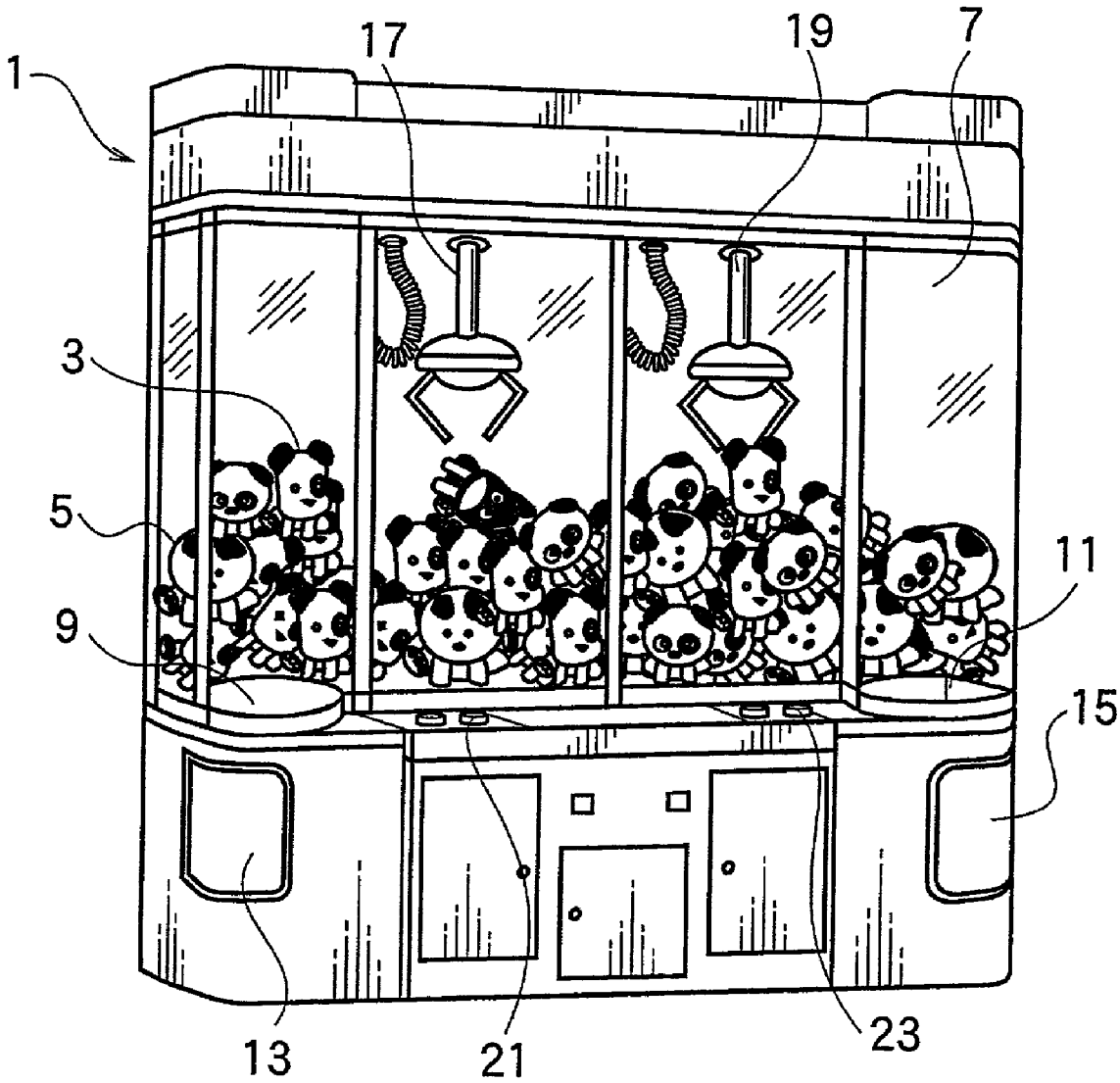
Fig.3 RELATED ART
FIG. 3 is a schematic configuration diagram of a game machine according to a related art.

FIGS. 1 and 2 are diagrams according to an embodiment of the present invention, in which FIG. 1 is a schematic configuration diagram of a game machine, and FIG. 2 is a schematic configuration diagram of essential parts. Like reference numerals are denoted to elements corresponding to those in FIG. 3.

In the present embodiment, the game machine has chute sections 25 and 27. The chute sections 25 and 27 are provided in paths leading from the drop ports 9 and 11 to taking-out ports 13 and 15 of prizes. The configurations of the chute sections 25 and 27 are identical to each other, the chute section 25 will be explained as a representative in FIG. 2.

The chute section 25 is provided with an RF antenna 29 as a reading section. The RF antenna 29 is connected to a reader circuit 31 as the reading section. The reader circuit 31 is connected to a wireless terminal device 33. The wireless terminal device 33 configures to send a signal by wireless. A signal from the wireless terminal device 33 is caused to be input into a wireless terminal device 39 connected via a PCMCI card 37 to, for example, a notebook type personal computer (notebook PC) 35 as an information terminal device which is a management system.

In the meantime, the stuffed animal 3, 5, . . . of the prize is attached with a RF tag 41 as a detection section for specifying the kind of the stuffed animal through a string 43. The RF tag 41 indicates an ID number for discriminating the kind of each stuffed animal 3, 5, . . . .

Next, an operation will be explained. At first, the kinds and the number of various stuffed animals 3, 5, . . . accommodated in the prize accommodating chamber 7 of the case 1 have been input and stored in advance into the note PC 35. When the player succeeds in catching any stuffed animal 3, 5, . . . , and the stuffed animal 3, 5, . . . is dropped from the drop port 9 or 11, the stuffed animal passes through the chute section 25.

In the chute section 25, the RF antenna 29 detects the ID number of the RF tag 41 of each stuffed animal 3, 5, . . . and inputs the signal into the reader circuit 31. In the reader circuit 31, the ID number is read according to the signal from the RF antenna 41, and a wireless signal is transmitted from the wireless terminal device 33 to the wireless terminal device 39 at the note PC 35 side.

In the note PC 35, according to the input signal, for example, data corresponding to the ID number of the caught stuffed animal 3, 5, . . . is stored, or is subtracted from the initially input number. Thereby, it is possible to automatically confirm what kind of stuffed animals 3, 5, . . . and how many stuffed animals 3, 5, . . . currently remain in the prize accommodating chamber 7 on the note PC 35.

Therefore, the administrator of the game machine can immediately grasp the popular prize and the like without fully counting the number of stuffed animals 3, 5, . . . in the prize accommodating chamber 7, and conduct the restock thereof with remarkable ease. Further, when the popular prize can be grasped, it is possible to positively increase the number thereof, which is remarkably advantageous for the prize management.

Further, when the detection section is read as the RF tag 41 by the RF antenna 29, and the size of the chute section 25 is set within the range in which the RF tag 41 can be read by the RF antenna 29. In this case, even when the stuffed animal 3, 5, . . . is dropped through the chute section 25 in any form, the detection section can be reliably read to thereby conduct accurate detection.

In the above embodiment, the detection section is handled as the RF tag 41, and the reading section is handled as the RF antenna 29 and the reader circuit 31; however, a configuration may be employed in which a CCD camera or the like as the reading section is used to read specific marks provided on the stuffed animals 3, 5, . . . as the detection section.

What is claimed is:

1. A prize management system comprising:

a game machine, said game machine internally storing a plurality of prizes and being externally engagable by a player for providing the player with one stored prize selected by the player;

said system further comprising:

a case, said case having a first section for storing said plurality of prizes;

said case having a second section distanced from said first area and not storing said plurality of prizes;

a drop port connected to a bottom of said case in said second section for receiving said one prize selected by said player;

a chute section for extending below said drop port, said chute descending and passing said one prize in a downwardly extending path;

a taking-out port provided with the case, said taking-out port connected below said chute path, said taking out port discharging said one prize to the player;

a detection section connected with a string to each one of the prizes, the detection section specifying a kind of the prize and being detectable in a non-contacting manner;

a reading section arranged at the chute section, for reading the detection section of the prize only as the prize passes through the chute section to be taken out in the non-contacting manner, said reading section being incapable of reading the detection section of prizes disposed in said first section of said case; and management means for managing prizes in the case on the basis of a result read by the reading section.

2. The prize management system of a game machine according to claim 1, wherein the detection section is a radio frequency identification (RFID) tag, and the reading section comprises a radio frequency (RF) antenna provided in the chute section and a reader circuit for reading a signal of the RF antenna.

3. A prize management system for a game machine, comprising:

a case including a first section for containing a plurality of prizes for selection by and award to game player winners;

a withdrawal port in through which a prize that has been selected by a game player winner is withdrawn from the case;

a prize identification tag attached to each prize, bearing electronically readable indicia identifying the prize;

a downwardly extending passageway connected to bottom of a second section of said case through which one prize selected by a game player winner passes as it moves from the case to the withdrawal port, said plurality of prizes not being stored in said second section;

prize identification tag reading means, positioned in the passageway, for electronically reading, in a non-contact manner, information from the prize identification tag of a prize selected by a game player winner only as the prize moves from the case to the withdrawal port, said prize identification tag reading means being incapable of reading information from the prize identification tag of a prize disposed in said first section of said case; and prize management means for managing and accounting for the prizes in the case based on information electronically read and obtained from the prize identification tags of those prizes that have bee removed from the case and withdrawn through the withdrawal port by game player winners.

* * * * *